US010967384B2

(12) United States Patent
Green et al.

(10) Patent No.: US 10,967,384 B2
(45) Date of Patent: Apr. 6, 2021

(54) GRINDING MILL

(71) Applicant: OUTOTEC (FINLAND) OY, Espoo (FI)

(72) Inventors: Nicholas Green, Oslo (NO); Brian Berger, Castle Rock, CO (US); Damon Bordi, Hillarys (AU); Kjell Winther, Oslo (NO); Bjoern Holshagen, Flateby (NO)

(73) Assignee: OUTOTEC (FINLAND) OY, Espoo (FI)

( * ) Notice: Subject to any disclaimer, the term of this patent is extended or adjusted under 35 U.S.C. 154(b) by 200 days.

(21) Appl. No.: 16/165,573

(22) Filed: Oct. 19, 2018

(65) Prior Publication Data

US 2020/0122155 A1 Apr. 23, 2020

(51) Int. Cl.

| | |
|---|---|
| ***B02C 17/00*** | (2006.01) |
| ***B02C 17/18*** | (2006.01) |
| ***B02C 17/04*** | (2006.01) |

(52) U.S. Cl.

CPC ..... *B02C 17/181* (2013.01); *B02C 17/04* (2013.01); *B02C 17/183* (2013.01)

(58) Field of Classification Search

CPC ..... B02C 17/181; B02C 17/183; B02C 17/04
USPC ..... 241/285.1–285.3, 299
See application file for complete search history.

(56) References Cited

U.S. PATENT DOCUMENTS 1,369,653 A * 2/1921 Hall ..... B02C 17/183 241/80
1,470,597 A * 10/1923 John ..... B02C 17/22 241/102
1,517,538 A * 12/1924 Daman ..... B02C 17/181 241/177
1,601,956 A * 10/1926 Gammeter ..... B02C 17/225 241/102
1,787,897 A * 1/1931 Durnin ..... B02C 17/06 241/72

(Continued)

FOREIGN PATENT DOCUMENTS

JP S52147364 A 12/1977

OTHER PUBLICATIONS

Notification of Transmittal of the International Search Report and the Written Opinion of the International Searching Authority, or the Declaration issued by the Finnish Patent and Registration Office acting as the International Searching Authority in relation to International Application No. PCT/FI2019/050326 dated Jun. 19, 2019 (13 pages).

*Primary Examiner* — Faye Francis
(74) *Attorney, Agent, or Firm* — Robert P. Michal, Esq.; Carter, DeLuca & Farrell LLP

(57) ABSTRACT

An open-ended grinding mill (1) includes a drum (2) including a cylindrical shell (3), wherein the longitudinal axis (4) of the drum is arranged in a substantially horizontal position in a use position of the grinding mill (1). The drum (2) includes a first end (5) at the feed end of the shell and a second end (6) at the discharge end of the shell. The grinding mill further includes a bearing (8) supporting the drum at the second end, and a support structure (9) to connect the drum (2) to the bearing (8). The support structure is configured to provide a wall external to the shell, whereby the shell and the support structure provide a double-wall structure separating the bearing from the inside of the drum.

20 Claims, 6 Drawing Sheets

(56) References Cited

U.S. PATENT DOCUMENTS 2,058,257 A * 10/1936 Porteous ..... B02C 17/225 241/102
2,193,956 A * 3/1940 Abrams ..... B02C 17/225 241/183
2,256,841 A * 9/1941 Hardinge ..... B02C 17/04 241/41
2,297,804 A * 10/1942 Siegfried ..... B02C 17/04 241/153
2,470,315 A * 5/1949 McGehee ..... B02C 17/06 241/45
2,566,103 A * 8/1951 Weston ..... B02C 17/22 241/181
2,621,859 A * 12/1952 Phillips ..... B02C 17/16 241/47
2,702,217 A 2/1955 Treshow
2,702,218 A 2/1955 Schoonover
2,967,671 A * 1/1961 Falla ..... B02C 17/22 241/183
3,231,203 A * 1/1966 Hardinge ..... B02C 17/1845 241/24.1
3,286,747 A * 11/1966 Delcellier ..... B27L 1/025 144/208.9
4,032,075 A * 6/1977 Tyer, Sr. ..... B02C 17/06 241/45
4,089,476 A * 5/1978 Gauer ..... B02C 17/04 241/70
4,243,182 A * 1/1981 Dugger, Jr. ..... B02C 17/22 241/153
4,262,715 A * 4/1981 Hausler ..... B27L 1/025 134/122 R
4,369,823 A * 1/1983 Gustafsson ..... B27L 1/025 144/340
4,394,982 A * 7/1983 Wilson ..... B02C 17/22 241/183
4,424,938 A * 1/1984 Day ..... B02C 17/225 241/182
4,736,894 A * 4/1988 Ferrada ..... B02C 17/22 241/183
4,744,525 A * 5/1988 Ortega De La Orden ..... B02C 17/183 241/171
4,911,554 A 3/1990 Henne et al.
5,390,866 A * 2/1995 Kochnev ..... B02C 17/22 241/181
5,638,887 A * 6/1997 Didion ..... B02C 17/22 164/269
5,839,490 A * 11/1998 Kiedaisch ..... B02C 17/225 144/208.9
6,220,536 B1 * 4/2001 Isaji ..... B02C 17/04 241/171
6,592,250 B1 * 7/2003 Gement ..... B01F 9/0034 366/192
7,198,217 B2 * 4/2007 Gildersleeve ..... B02C 17/225 241/299
2013/0092777 A1 * 4/2013 Belke ..... B02C 17/24 241/284
2014/0203128 A1 * 7/2014 Enders ..... B02C 17/18 241/176
2015/0345556 A1 * 12/2015 Braithwaite ..... F16C 32/0666 384/114
2016/0107164 A1 * 4/2016 Enderle ..... B02C 17/182 241/179
2016/0121337 A1 * 5/2016 Green ..... B02C 17/04 241/179

* cited by examiner

GRINDING MILL

BACKGROUND

The invention relates to grinding mills, and more particularly to open-ended grinding mills.

Grinding mills, specifically semi autogenous and autogenous mills, rely on their ability to generate impact breakage of the ore charge and transport the ground material through the discharge pulp lifters out of the mill. It is common with increasing mill diameters and flow rates for the discharge arrangement to restrict the performance of the mill by limiting material transfer rates and grinding efficiency. This is due to an inability to transport the ground material through the grate and pulp lifters limiting the transfer rate due to slurry flow back/short circuiting and carry over. The impact of this restriction in mill flow rate is a reduction in mill performance (product size) due to the resulting slurry pool which dissipates the energy of the balls/ore impacting the toe of the charge.

While open ended mills can provide a solution to this problem removing the need for pulp lifters such that slurry can flow unhindered though the grate and out of the mill. However, this approach has been limited to very small grinding mills, as the open ended design has not been sufficiently stiff to support a journal with discrete bearing support points with increasing mill diameters and charge loads.

In order to achieve acceptable deflections at the journal, shell supported mills typically have a head plate supporting the journal with a large compound butt weld between them. This is the highest stressed point on the mill so the weld must be very large to facilitate a smooth radius at the transition in geometry minimising stresses. Due to the volume of weld material this connection can be problematic with reliability potentially reduced by the presence of weld defects and residual stresses. One of the problems associated with known open-ended grinding mills has, thus, been that in case of a malfunction there is a risk that oil from bearings supporting a drum of the grinding mill comes into contact with the material to be ground causing contamination of the material.

BRIEF DESCRIPTION

An object of the present invention to provide a new grinding mill. The objects of the invention are achieved by a grinding mill that is characterized by what is stated in the independent claim. Some preferred embodiments are disclosed in the dependent claims.

The invention is based on the idea of preventing a continuous path from being formed between the inside of the drum of the grinding mill and the oil in the bearing even during malfunction.

An advantage of the grinding mill is that contamination of the material to be ground is effectively prevented.

BRIEF DESCRIPTION OF THE DRAWINGS

In the following the invention will be described in greater detail by means of preferred embodiments with reference to the accompanying drawings, in which.

Figure 1:
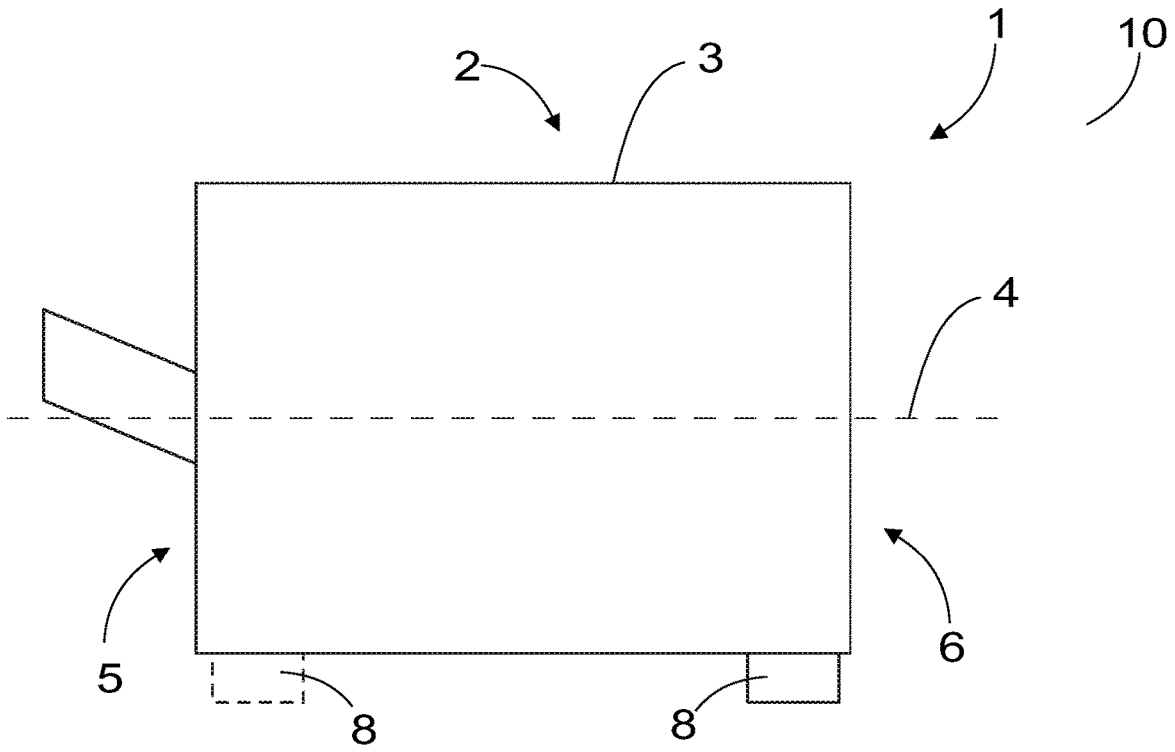
FIG. 1 illustrates schematically a grinding mill seen from a side.

The drawings are intended to illustrate the main principles described in this description and the embodiments only. The drawings are not shown in scale and not all the similar features are provided with reference numbers in the drawings for sake of clarity.

DETAILED DESCRIPTION OF THE INVENTION

Figure 2:
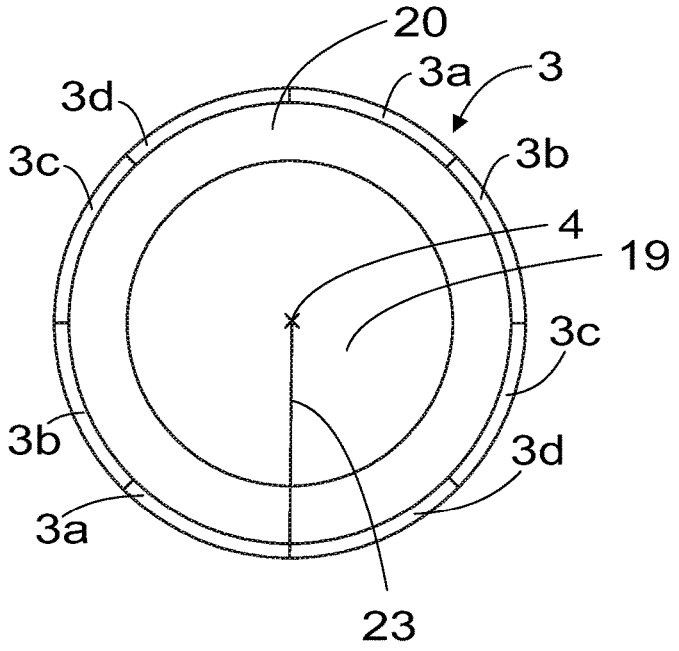
FIG. 2 illustrates schematically a grinding mill seen from the second end.

FIG. 1 is illustrates schematically a grinding mill 1. FIG. 2 illustrates schematically a grinding mill 1 seen from a second end 6, in other words the discharge end of the grinding mill. FIGS. 1 and 2 only show some features of the grinding mill 1 that help understanding the current solution. It is clear for a person skilled in the art that a grinding mill may and usually does comprise other features as well.

A grinding mill 1, such as the grinding mill of FIG. 1, comprises a drum 2 comprising a cylindrical shell 3. In a grinding mill 1 of the current solution, the longitudinal axis 4 of the drum 2 is arranged in a substantially horizontal position in a use position of the grinding mill 1. The longitudinal axis 4 of the drum refers to the axis extending along the centre line of the shell 3 from one end of the cylinder-shaped shell s to another. Horizontal position refers to the longitudinal axis 4 extending in a substantially horizontal direction. In other words, the longitudinal axis 4 extends in a direction that is closer to a horizontal direction than a vertical direction. The use position refers to a position the grinding mill 1 is arranged in when used for grinding, for instance for ore grinding, in a production environment.

The drum 2 comprises a first end 5 at the feed end of the shell and a second end 6 at the discharge end of the shell. The feed end refers to the end at which the material to be ground is fed into the drum. The discharge end refers to the end at which the ground material is discharged from the drum. In wet grinding applications the discharged material comprising ground material and possibly liquids is also called slurry in this application.

The grinding mill 1 may comprise various process duties including but not limited to a ball mill, a pebble mill, an autogenous mill (AG mill), or a semiautogenous mill (SAG mill). Working principles of such grinding mills are known and are not explained in more detail in this description.

According to an embodiment, the shell 3 may be formed, at least at the second end 6, of at least two shell segments 3*a*, 3*b*, 3*c*, 3*d* split in the transverse direction of the drum 2. In other words, at least the part of the shell 3 located closest to the second end 6 is formed of such shell segments 3*a*, 3*b*, 3*c*, 3*d*. The part of the shell 3 located closest to the second end 6 may be formed of for instance two to eight such shell segments 3*a*, 3*b*, 3*c*, 3*d*, for instance of eight segments as in FIG. 2 or of four shell segments, such as in FIG. 6. In other words, the part of the shell 3 located closest to the second end 6 may be comprise shell segments in the range of two to eight segments. The transverse direction of the drum 2 refers to the plane transverse to the longitudinal axis 4 of the drum. The cylindrical shape of the shell 3 being split in the transverse direction of the drum refers to the shell 3 being split into segments in directions extending radially from the longitudinal axis 4 of the drum towards the outer periphery of the shell 2. The shell segments 3*a*, 3*b*, 3*c*, 3*d*, thus, form a cylindrical shape when attached together. Depending on the embodiment, the shell segments 3*a*, 3*b*, 3*c*, 3*d* may be symmetrical, whereby the shell 3 is divided into shell segments of equal size, or asymmetrical, whereby the shell segments may be of different sizes. This is beneficial, as the parts to be delivered to the grinding site may be made smaller and may, therefore, be easier to handle and transport than in case the shell consists of one tube-like part. This is particularly beneficial in connection with larger grinding mills, in other words grinding mills with a drum of a larger diameter. In some cases, manufacturing and transporting requirements may even limit the maximum size of grinding mills, as very large shells may be too large to manufacture or to transport to the site.

According to an embodiment, the shell 3 may also be divided into sections 3', 3", 3''' in the longitudinal direction of the drum, in other words in the direction of the longitudinal axis 4 of the drum. All these sections or at least the one closest to the second end 6 may be formed of shell segments 3*a*, 3*b*, 3*c*, 3*d*. Each of the shell sections 3', 3", 3''', thus, forms a cylindrical shape and these shell sections are attached to one another adjacently in the direction of the longitudinal axis 4 of the drum.

The grinding mill 1 further comprises a bearing 8 supporting the drum 2 at the second end 6. The bearing 8 may comprise any suitable type of bearing, such as a roller bearing, a hydrostatic bearing, a hydrodynamic bearing or a ball bearing. It should also be noted that the grinding mill 1 may also have additional bearings supporting the drum 2 and/or other parts of the grinding mill 1. Such bearings 8 for supporting the drum of the grinding mill are known as such and are not explained in more detail.

According to an embodiment, the grinding mill 1 further comprises a support structure 9 to connect the drum 2 to the bearing 8. The support structure 9 may be provided outside the shell 3, in other words outside the core of the grinding mill, or volume of the grinding mill, where the material to be ground is provided. Thereby, the support structure 9 may provide a wall external to the shell 3, whereby the shell 3 and the support structure 9 provide a double-wall structure separating the bearing 8 from the inside of the drum 2. In other words, the shell 3 forms one wall between the bearing 8 and the inside of the drum 2, and the support structure 9 forms a second wall between the bearing 8 and the inside of the drum 2. This kind of a double-wall structure between the bearing 8 and the inside of the shell 3 of the drum 2, where the material to be ground is provided, effectively separates the oil in the bearing and the material to be ground, such as slurry, from one another. Due to the double-wall structure separating the bearing 8 from the inside of the drum 2, there is no continuous path between the bearing and the material to be ground.

According to an embodiment, the support structure 9 may be formed of at least two support structure segments 9*a*, 9*b*, 9*c*, 9*d* split in the transverse direction of the drum 2. In other words, the support structure 9 may be split into segments in a manner and in a direction similar to the split of the shell 3 into shell segments 3*a*, 3*b*, 3*c*, 3*d*. That means that the support structure segments 9*a*, 9*b*, 9*c*, 9*d* form, when attached together, a circular and/or cylindrical structure.

Figure 6:
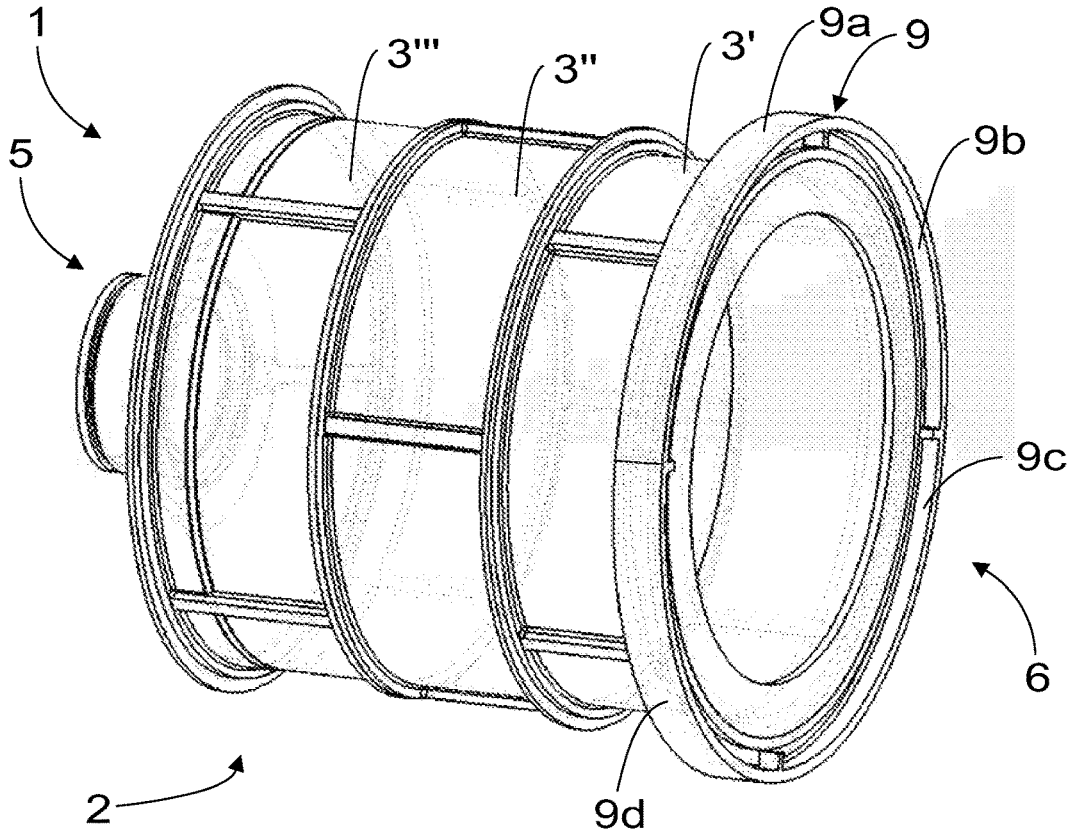
FIG. 6 illustrates schematically a shell and an embodiment of a support structure.

Depending on the embodiment, the number of support structure segments 9*a*, 9*b*, 9*c*, 9*d* may be in the range of two to eight support structure segments, for instance four support structure segments such as in FIG. 6. Depending on the embodiment, the number of support structure segments may be equal to the number of shell segments or the number of support structure segments may differ from the number of shell segments.

According to an embodiment, the shell 3 and the support structure 9 are attached to one another at the second end 6 in such a manner, that the splits of the shell segments are indexed from the splits of the support structure segments. The splits of the shell segments being indexed from the splits of the support structure segments refers to the splits, in other words the surfaces connecting the segments, of the shell segments being arranged at different positions along the periphery 12 of the drum 2 when compared to the splits of the support structure segments. In other words, the splits of the support structure segments and the splits of the shell segments are not aligned in any position of the periphery of the shell 3. This is particularly beneficial, as this enables forming the shell and the support structure from segments, in other words making bigger grinding mills with parts of a size considerably easier to manufacture and transport than in non-split constructions, without compromising the sealing between the bearing 8 and the inside of the shell 3. This is because there are no splits extending from the bearing surface to the interior of the drum, such as in traditional solutions, where the support structure is formed as a part of the shell and/or the drum and the possible splits extend from the bearing to the volume of the drum.

According to an embodiment, the support structure 9 comprises a journal providing a counter surface for a bearing supporting the drum of a grinding mill. Some embodiments of geometries of support structures, wherein the support structure may preferably comprise a journal, are presented in FIGS. 3 to 5.

Figure 3:
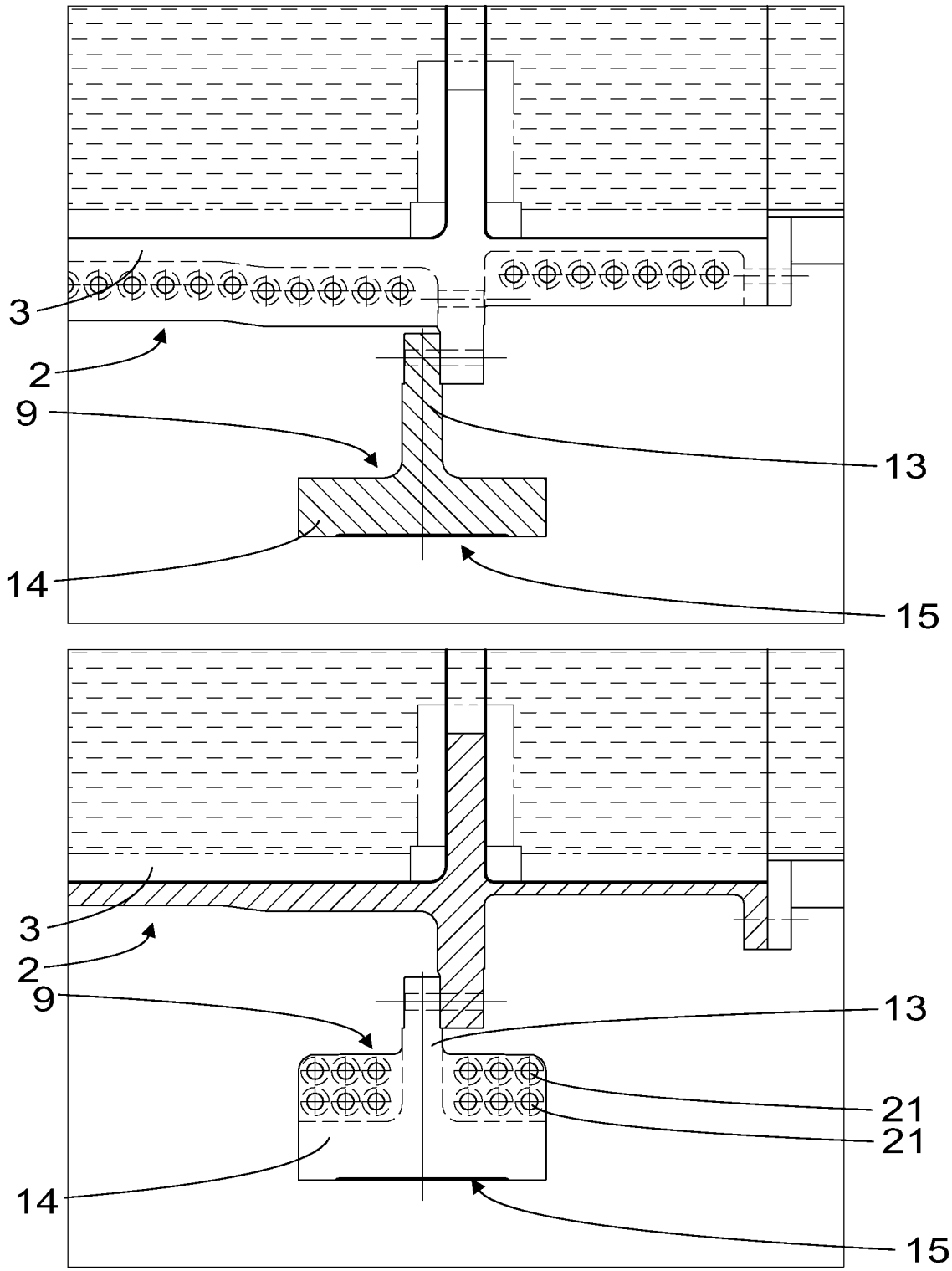
FIG. 3 illustrates schematically a detail of a shell and an embodiment of a support structure at two cross sections along the periphery of the shell and the support structure.

FIG. 3 illustrates schematically a detail of a shell 3 and an embodiment of a support structure at two cross sections along the periphery of the shell and the support structure. More particularly, the drawing on the top shows a cross section at a split of shell segments and the drawing on the bottom shows a cross section at a split of support structure segments. In this embodiment, the support structure 9 has a T-shaped cross section. In other words, the support structure comprises a radial part 13 extending in a radial direction of the support structure 9 and, thus, the drum 2, and a longitudinal part 14 extending in a longitudinal direction of the support structure 9 and, thus, the drum 2. The longitudinal part 14 of the support structure 9, thus, forms a ring-like or a ring-segment-like structure providing a counter surface 15 for the bearing 8. The bearing 8 is not shown in FIGS. 3 to 8, but it is configured to become in contact with the counter surface 15. The radial part 13 of the support structure 9, on the other hand, extends from a middle section of the longitudinal part 14 in the radial direction of the drum towards the shell 3 and, more particularly, the longitudinal axis 4 of the drum. The longitudinal part 14 and the radial part 13, thus, form a T-shaped cross section. Such journals may also be called riding rings.

Figure 4:
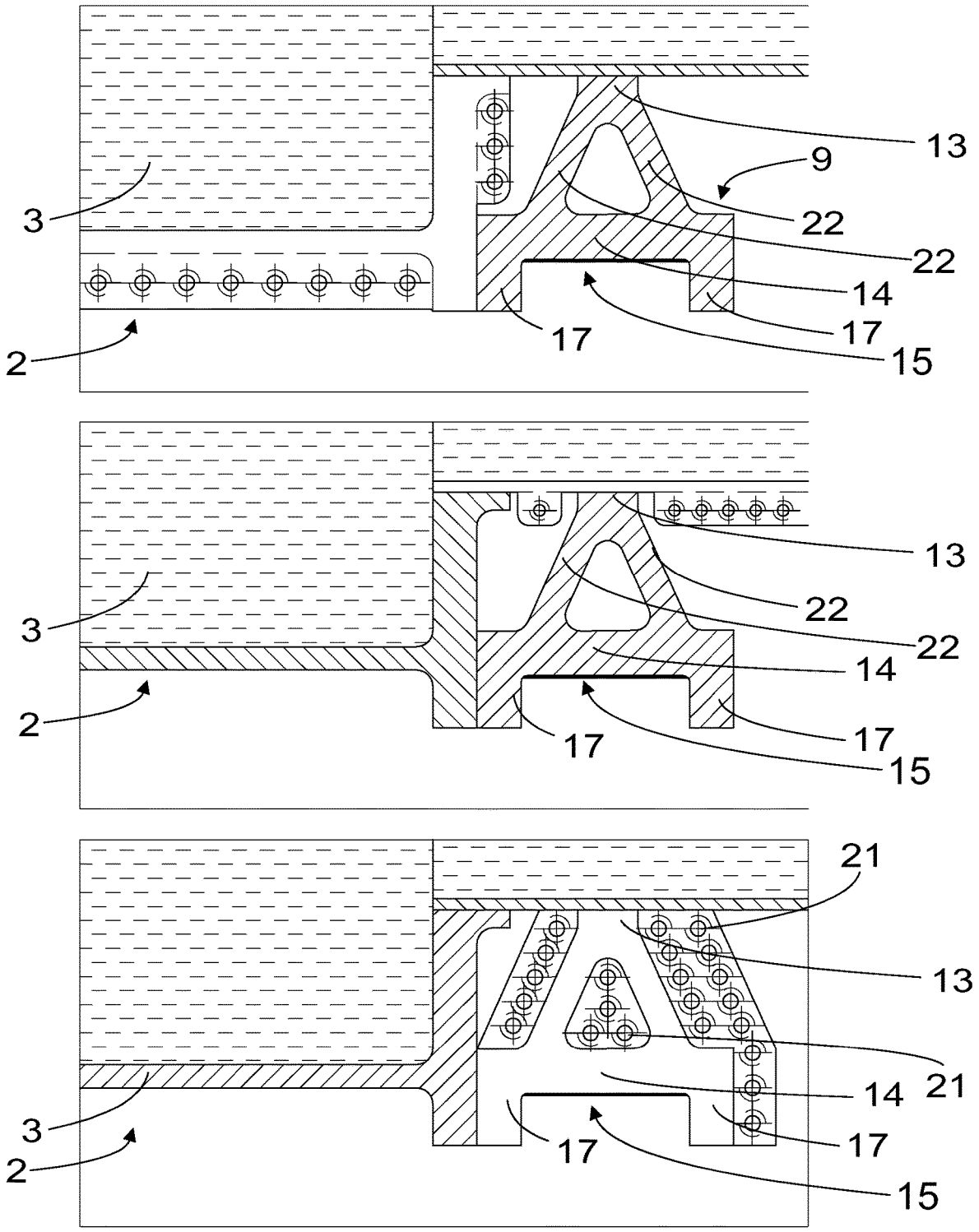
FIG. 4 illustrates schematically a detail of a shell and another embodiment of a support structure at three cross sections along the periphery of the shell and the support structure.

FIG. 4 illustrates schematically a detail of a shell 3 and another embodiment of a support structure 9 at three cross sections along the periphery of the shell and the support structure. More particularly, the drawing on the top shows a cross section at a split of shell segments and the drawing on the bottom shows a cross section at a split of support structure segments. The drawing in the middle shows a third cross section along the periphery of the shell and the support structure. In this embodiment, the support structure 9 has a Y-shaped cross section. In other words, the support structure 9 comprises a longitudinal part 14 extending in a longitudinal direction of the support structure 9 and, thus, the drum 2. The longitudinal part 14 of the support structure 9, thus, forms a ring-like or a ring-segment-like structure providing a counter surface 15 for the bearing 8. The support structure 9 further comprises the support structure comprises a radial part 13 extending in a radial direction of the support structure 9 and, thus, the drum 2. The radial part 13 is connected to the longitudinal part 14 by two angled parts 22 in such a manner that the radial part 13 and the angled parts 22 form a triangular cross section. The radial part 13 of the support structure 9 connects the angled parts 22 and extends in the radial direction of the drum from the inner ends of 16 of the angled parts 22 towards the longitudinal axis 4 of the drum. The radial part 13 is preferably located at a substantially equal distance from the edges of the longitudinal part 14, such that the radial part 13, the angled parts 22 and the longitudinal part 14 form a substantially symmetrical cross section. The support structure 9 preferably further comprises a second flange 17 at each edge of the longitudinal part 14 extending at least outwards from the outer surface of the longitudinal part. The outer surface of the longitudinal part is the surface providing the counter surface 15 for the bearing 8. The second flanges 17 may, thus be parallel to one another and also to the radial part 13.

Figure 5:
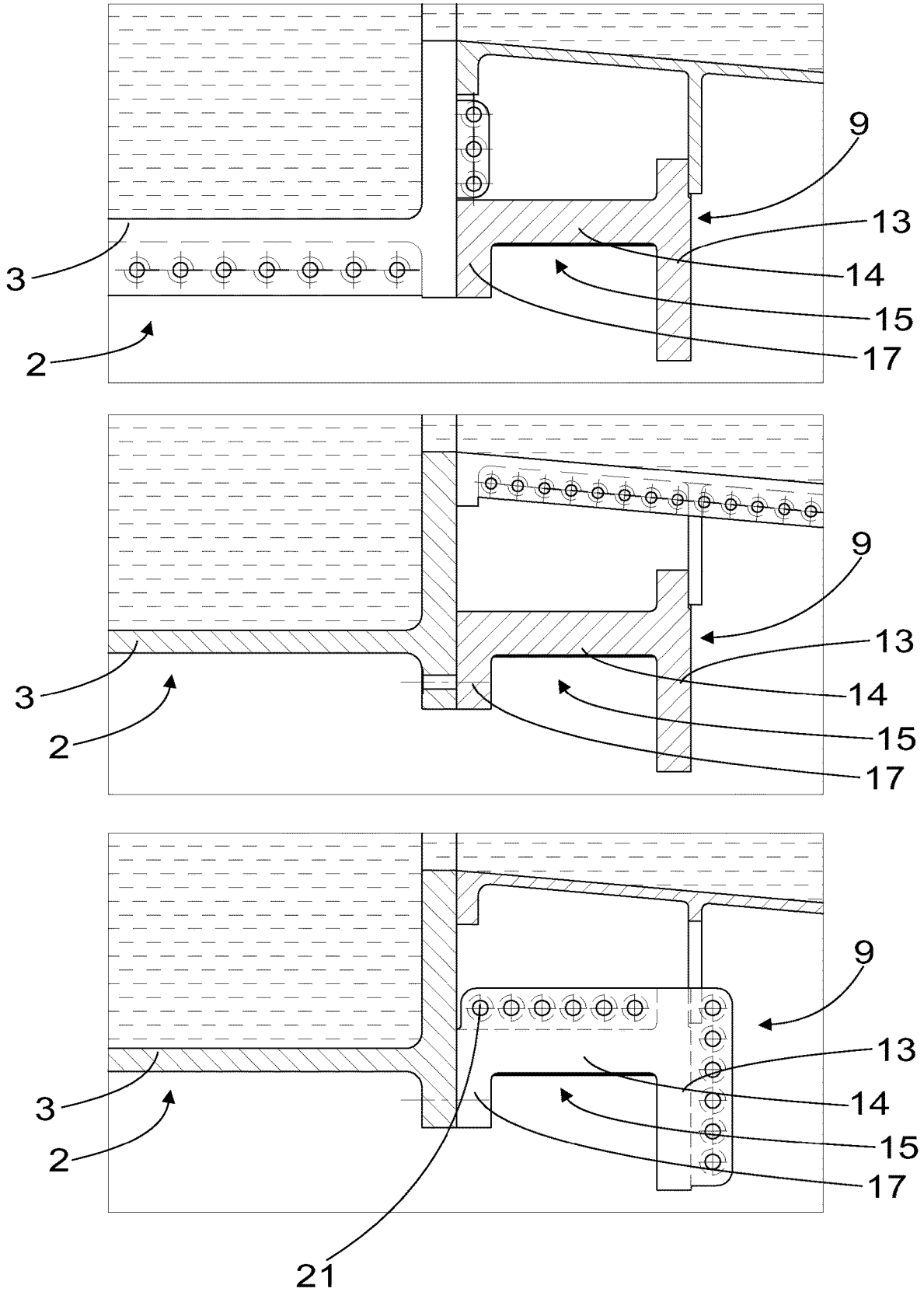
FIG. 5 illustrates schematically a detail of a shell and a third embodiment of a support structure at three cross sections along the periphery of the shell and the support structure.

FIG. 5 illustrates schematically a detail of a shell 3 and a third embodiment of a support structure 9 at three cross sections along the periphery of the shell and the support structure. More particularly, the drawing on the top shows a cross section at a split of shell segments and the drawing on the bottom shows a cross section at a split of support structure segments. The drawing in the middle shows a third cross section along the periphery of the shell and the support structure. In this embodiment, the support structure 9 has an H- or semi-H-shaped cross section. In other words, the support structure 9 comprises a longitudinal part 14 extending in a longitudinal direction of the support structure 9 and, thus, the drum 2. The longitudinal part 14 of the support structure 9, thus, forms a ring-like or a ring-segment-like structure providing a counter surface 15 for the bearing 8. The support structure 9 further comprises a radial part 13 extending in a radial direction of the support structure 9 and, thus, the drum 2. The radial part 13 is connected to the longitudinal part 14 at the edge of the longitudinal part 14 directed away from the drum 2 and extends in the radial direction of the drum both inwards towards the longitudinal axis 4 of the drum and outwards away from the longitudinal axis 4 of the drum. In other words, the radial part 13 extends in a radial direction both inwards and outwards from the longitudinal part 14. The support structure 9 further comprises a second flange 17 at the edge of the longitudinal part 14 directed towards the drum 2, the second flange 17 extending at least outwards from the outer surface of the longitudinal part, forming a semi-H-shaped cross section for the support part 9. The outer surface of the longitudinal part is the surface providing the counter surface 15 for the bearing 8. The second flange 17 may also extend inwards from the longitudinal part 14, forming a H-shaped cross section for the support part 9. The second flange 17 and the radial part 13 may, thus, be provided at opposite edges of the longitudinal part 14 and be parallel to one another.

According to an embodiment, the support structure segments 9*a*, 9*b*, 9*c*, 9*d* may be mounted to one another in such a manner, that the longitudinal part 14 of the support structure 9 is fully supported over its length in the direction of the longitudinal axis 4 of the drum 2. In other words, the adjacent support structure segments 9*a*, 9*b*, 9*c*, 9*d* may be mounted to one another in such a manner that there is no unsupported length along the area of the longitudinal part 14. According to an embodiment, this is implemented by mounting the adjacent support structure segments to one another by bolts 21 in such a manner, that bolts are provided substantially along the whole length of the longitudinal part 14 of the support structure, such as a journal, in the longitudinal direction of the drum 2, in other words in the direction of the longitudinal axis 4 of the drum 2. In the FIGS. 3 to 5 this length of the longitudinal part 14 extends, thus, in the same direction as the counter surface 15 for the bearing.

Figure 7:
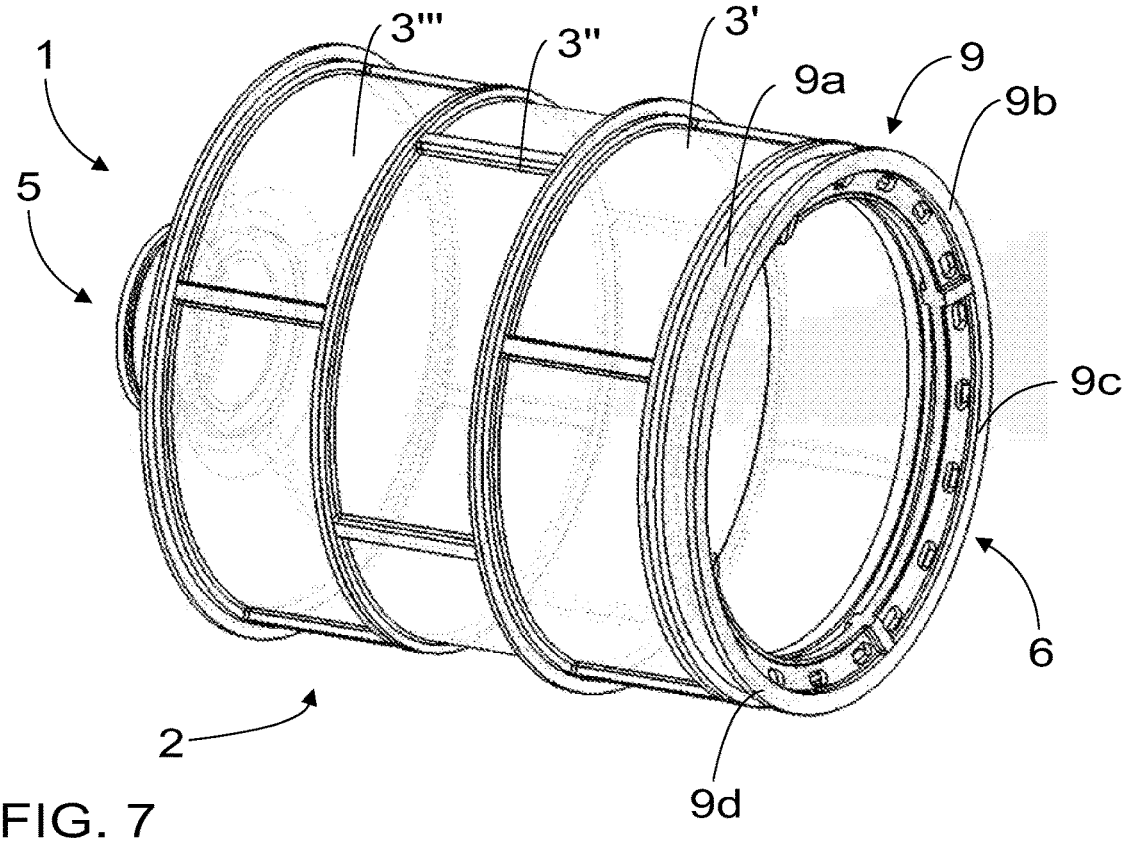
FIG. 7 illustrates schematically a shell and another embodiment of a support structure.
Figure 8:
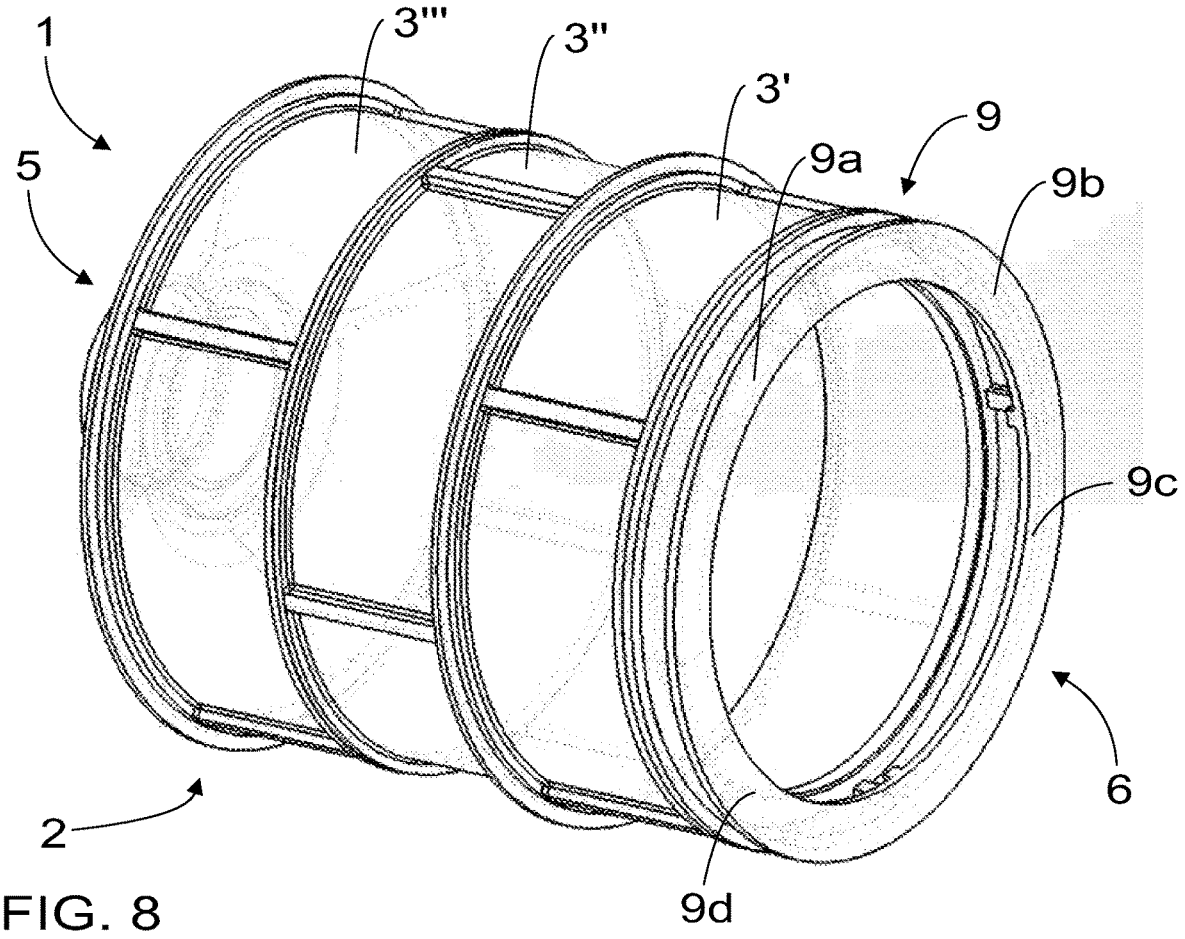
FIG. 8 illustrates schematically a shell and a third embodiment of a support structure.

FIG. 6 illustrates schematically a shell and an embodiment of a support structure, wherein the cross section of the support structure is similar to that of the embodiment of FIG. 3. FIG. 7 illustrates schematically a shell and another embodiment of a support structure, wherein the cross section of the support structure is similar to that of the embodiment of FIG. 4. FIG. 8 illustrates schematically a shell and a third embodiment of a support structure, wherein the cross section of the support structure is similar to that of the embodiment of FIG. 5. The cross sections of the support structures in FIGS. 3 to 8 are shown as selected embodiments only and the cross sections of the support structure 9 may vary from those shown in the drawings within what is said in the description and the claims.

According to an embodiment, the support structure 9 may comprise a cast structure. According to another embodiment, the support structure 9 may comprise a fabricated structure.

According to an embodiment, the support structure 9 may comprise spheroidal graphite iron. According to other embodiments, the support structure 9 may comprise cast steel, fabricated steel or some other suitable material.

According to an embodiment, the support structure 9 may be removably attached to the shell 3. The support structure 9 may for instance be removably attached to the shell 3 by bolts or other mounting equipment suitable for removably attaching metal structures to one another. According to other embodiments, the support structure 9 may be fixedly attached to the shell 3, for instance by welding or in similar method suitable for fixedly attaching metal structures to one another.

According to an embodiment, the shell 3 may comprise a first flange 7 extending in a radial direction of the shell at the second end 6. The support structure 9 may be attached to the first flange 7 removably or fixedly depending on the embodiment, According to an embodiment, the grinding mill 1 may be an open-ended grinding mill. Open-ended grinding mill refers to a grinding mill that does not have a discharge trunnion, pulp lifters to lift the ground material to the discharge trunnion or a solid discharge head plate. An open-ended grinding mill may comprise a discharge grate 19 instead of the discharge trunnion, pulp lifter and solid discharge head plate, whereby the ground material is discharged through the discharge grate 19. In a fully open-ended grinding mill there is no need to lift the ground material to discharge it. According to another embodiment, the open-ended grinding mill 1 may comprise a partial head plate 20 at the discharge end. Such a grinding mill may also be called a semi-open-ended grinding mill. A semiopen-ended grinding mill may be similar to the fully open-ended grinding mill, but have a partial head plate 20 at the discharge end of the shell extending partially from the second end the shell 3 towards the longitudinal axis 4 of the drum, but no discharge trunnion and no traditional pulp lifters. The partial head plate 20 at the discharge end of the shell 3 may extend a distance of preferably less than 50 percent, more preferably less than 30 percent and most preferably less than 15 percent of the length the radius 23 of the shell from the edge of the shell 3 towards the longitudinal axis 4 of the drum. The area of the second end 6 of the drum 2 extending from the inner edge of the partial head plate 20 towards the longitudinal axis 4 of the drum 2 may comprise a discharge opening 11. The discharge opening may be provided with a discharge grate 19. In both types of open-ended grinding mills, in other words in both fully open-ended and semi-open-ended grinding mills, the ground material may, thus, be discharged from the discharge grate 19 straight to the atmosphere.

The support structure 9 may participate in a sealing between the shell 3 and the bearing 8 to prevent slurry in the shell and oil in the bearing from coming into contact with one another. The support structure may be configured to prevent a continuous path from being formed between the bearing and the inside of the shell. This may be achieved by providing the double-wall structure by the support structure and/or indexing the splits of the shell segments and the support structure segments. In addition, in the embodiments described in this description and accompanying drawings, the splits in the support structure do not extend to the volume of the drum, in other words the inside of the shell, where the material to be ground is provided. Therefore, even if there was a leakage in the bearing, the oil from the bearing would not become in contact with the material to be ground. The embodiments of the support structure described in this description and accompanying drawings also provide a stiff and self-supporting support structure. This improves the durability of the connection between the drum and the bearing and enables the grinding mill to be formed as an openin ended or semi-open-ended grinding mill even with very large diameters, which enables larger volumes of material to be ground in and discharged from the grinding mill.

It will be obvious to a person skilled in the art that, as the technology advances, the inventive concept can be implemented in various ways. The invention and its embodiments are not limited to the examples described above but may vary within the scope of the claims.

The invention claimed is:

1. An open-ended grinding mill comprising:

a drum comprising a cylindrical shell, wherein a longitudinal axis of the drum is arranged in a substantially horizontal position in a use position of the open-ended grinding mill, wherein the drum comprises a first end at a feed end of the cylindrical shell and a second end at a discharge end of the cylindrical shell, a bearing supporting the drum at the second end of the drum, and a support structure to connect the drum to the bearing, wherein the support structure provides a wall external to the cylindrical shell, whereby the cylindrical shell and the support structure provide a double-wall structure separating the bearing from an inside of the drum.

2. The grinding mill according to claim 1, wherein the cylindrical shell is formed, at least at the second end of the drum, of at least two shell segments split in a transverse direction of the drum, and wherein the cylindrical shell and the support structure are attached to one another at the second end of the drum in such a manner, that splits of the shell segments are indexed from splits of support structure segments of the support structure.

3. The grinding mill according to claim 2, wherein the number of support structure segments is in the range of 2 to 8 segments.

4. The grinding mill according to claim 1, wherein the support structure comprises a journal.

5. The grinding mill according to claim 4, wherein the support structure comprises a longitudinal part and a radial part, and wherein the longitudinal part is configured to form a counter surface for the bearing.

6. The grinding mill according to claim 5, wherein the support structure comprises at least two support structure segments mounted to one another in such a manner, that the longitudinal part of the support structure is fully supported over its length in a direction of the longitudinal axis of the drum.

7. The grinding mill according to claim 4, wherein the support structure has a T-shaped cross section.

8. The grinding mill according to claim 4, wherein the support structure has a Y-shaped cross section.

9. The grinding mill according to claim 4, wherein the support structure has an H- or semi-H-shaped cross section.

10. The grinding mill according to claim 1, wherein the support structure comprises spheroidal graphite iron.

11. The grinding mill according to claim 1, wherein the support structure is removably attached to the cylindrical shell.

12. The grinding mill according to claim 11, wherein the support structure is removably attached to the cylindrical shell by bolts.

13. The grinding mill according to claim 1, wherein the cylindrical shell comprises a first flange extending in a radial direction of the cylindrical shell at the second end of the drum and the support structure is attached to the first flange.

14. The grinding mill according to claim 1, wherein the grinding mill is a fully open-ended grinding mill.

15. The grinding mill according to claim 1, wherein the grinding mill is a semi-open-ended grinding mill.

16. The grinding mill according to claim 15, wherein the grinding mill comprises a circular open pulp lifter to transport slurry to a discharge opening of the grinding mill.

17. The grinding mill according to claim 1, wherein the support structure comprises a cast structure.

18. The grinding mill according to claim 1, wherein the cylindrical shell is formed, at least at the second end of the drum, of at least two shell segments split in a transverse direction of the drum, and the support structure is formed of at least two support structure segments split in the transverse direction, wherein the cylindrical shell and the support structure are attached to one another at the second end of the drum in such a manner, that splits of the shell segments of the cylindrical shell are radially offset from splits of the support structure segments of the support structure.

19. The grinding mill according to claim 1, wherein the support structure includes a plurality of arcuate, support structure segments that collectively surround the second end of the drum and protrudes longitudinally from the second end of the drum.

20. The grinding mill according to claim 1, wherein the second end of the drum has an end face that defines a discharge opening, the support structure covering the end face.

* * * * *